US005659840A

United States Patent [19]

Miyamoto et al.

[11] Patent Number: 5,659,840

[45] Date of Patent: Aug. 19, 1997

[54] DEVELOPING METHOD USING DEVELOPING ELECTRIC FIELD HAVING BACK-TRANSFER, TRANSFER AND REST STEPS

[75] Inventors: Toshio Miyamoto, Yokohama; Koichi Tanigawa, Tokyo; Masahiro Goto; Yozo Hotta, both of Yokohama, all of Japan

[73] Assignee: Canon Kabushiki Kaisha, Tokyo, Japan

[21] Appl. No.: 495,980

[22] Filed: Jun. 28, 1995

[30] Foreign Application Priority Data

Jun. 28, 1994 [JP] Japan ..... 6-146452

[51] Int. Cl.[6] ..... G03G 15/06

[52] U.S. Cl. ..... 399/55

[58] Field of Search ..... 355/200, 215, 355/245, 251, 252, 253, 261, 264, 265, 296, 298; 118/653, 657, 658; 399/53, 55, 222, 234, 235, 279, 285

[56] References Cited

U.S. PATENT DOCUMENTS

| | | |
|---|---|---|
| 4,370,049 | 1/1983 | Kuge et al. . |
| 4,385,829 | 5/1983 | Nakahata et al. . |
| 4,610,531 | 9/1986 | Hayashi et al. . |
| 5,066,979 | 11/1991 | Goto et al. . |
| 5,177,537 | 1/1993 | Okano et al. . |
| 5,185,496 | 2/1993 | Nishimura et al. . |
| 5,202,729 | 4/1993 | Miyamoto et al. . |
| 5,235,386 | 8/1993 | Yano et al. . |
| 5,260,746 | 11/1993 | Yoshida et al. . |
| 5,307,127 | 4/1994 | Kobayashi et al. . |
| 5,321,482 | 6/1994 | Yano et al. . |
| 5,387,963 | 2/1995 | Kajimoto et al. . |
| 5,404,213 | 4/1995 | Okano et al. . |
| 5,495,325 | 2/1996 | Nagahara . |

FOREIGN PATENT DOCUMENTS

| | | |
|---|---|---|
| 2-14704 | 4/1990 | Japan . |
| 2-14705 | 4/1990 | Japan . |

*Primary Examiner*—Sandra L. Brase

*Attorney, Agent, or Firm*—Fitzpatrick, Cella, Harper & Scinto

[57] ABSTRACT

A developing method includes the steps of opposing a developer carrying member to an image bearing member, the developing carrying member carrying a developer to the image bearing member for bearing an electrostatic image, supplying, to the developer carrying member, insulative one component developer having a weight average particle size of 4–8 microns, forming, between the image bearing member and the developer carrying member, an alternating electric field having a back-transfer period, transfer period and rest period, wherein a blank ratio of a sum of (i) the back-transfer period plus (ii) the transfer period and the rest period, during a developing operation, is 5:1–2:1.

17 Claims, 11 Drawing Sheets

RECT WAVE

BLANK 2:1

BLANK 1:1

DEVELOPING METHOD USING DEVELOPING ELECTRIC FIELD HAVING BACK-TRANSFER, TRANSFER AND REST STEPS

FIELD OF THE INVENTION AND RELATED ART

The present invention relates to a developing method and a developing device fur developing an electrostatic image on an image bearing member such as an electrophotographic photosensitive member or an electrostatic recording dielectric material.

FIG. 12 shows an example of an electrophotographic apparatus.

As shown in FIG. 12, a developing device 10 is disposed faced to a drum-like electrophotographic photosensitive member in the form of a photosensitive drum 1 (image bearing member) rotatable in a direction of an arrow. On the photosensitive drum 1, an electrostatic latent image is formed by a known electrostatic latent image forming means 20 including a charger, exposure means or the like. As for the exposure means, an optical system is used which deflects a laser beam modulated in accordance with an image signal or which projects an optical image of an original. The latent image formed on the photosensitive drum 1 is developed by the developing device 10 into a toner image.

The toner image is transferred onto a transfer material such as sheet by a known transfer means 30 including a transfer charger and so on. The transfer material now having the toner image is separated and conveyed to an unshown known fixing means, where the toner image is fixed on the toner image.

The residual toner on the photosensitive drum 1 after the image transfer is removed by a cleaner including a cleaning blade.

The developing device 10 contains insulative one component magnetic developer 11 not containing carrier particles in a developing container 12.

The one component magnetic developer, that is, the magnetic toner 11 is fed out of a container 12 by a non-magnetic developing sleeve 14 of aluminum stainless steel or the like (developer carrying member) rotating in the direction indicated by an arrow and is supplied to a developing zone where it is faced to the photosensitive drum 1. In the developing zone 13, the photosensitive drum 1 and the developing sleeve 14 are faced to each other with a small gap of 50–500 microns. In this developing zone 13, the toner 11 transfers onto the electrostatic latent image on the photosensitive drum 1 so that the electrostatic latent image is developed into the toner image.

The thickness of the developer layer 11*a* on the developing sleeve 14 is regulated by an elastic blade 16.

In this manner, in the developing apparatus shown in FIG. 12, the non-contact development is effected. Since the thickness of the toner layer 11*a* fed to the developing zone 13 is smaller than the small gap between the developing sleeve 14 and the photosensitive drum 1, the toner 11 jumps from the developing sleeve 14 onto the photosensitive drum 1 across the gap therebetween. In order to improve the development efficiency and to form a high density and sharp image having suppressed fog, the developing sleeve 14 is supplied with a developing bias voltage including an AC component from a bias voltage source 18.

As described above, the developing bias voltage comprises DC voltage biased with a AC voltage. Between the maximum value and the minimum value of the preferable developing bias voltage, the dark potential and the light potential exist, and the DC voltage value exists between the dark potential and the light potential of the latent image. Preferably, the frequency of the AC voltage is 1–2 kHz, and the peak-to-peak voltage (difference between maximum and minimum) is 1.1–1.8 kV approx. The waveform is a rectangular wave, a sunisoidal wave or a triangle wave or the like.

For example, when the latent image having the dark potential of −700 V and the light potential of −100 V, is reverse-developed by negative charge toner, the usable developing bias voltage has the DC component of −450 V and the AC component having the peak-to-peak voltage of 1.8 kHz (rectangular wave).

This bias voltage is effective to alternately provide the electric field in the direction of transferring the toner to the photosensitive drum 1 from the developing sleeve 14 and the electric field in the direction of transferring the toner back from the photosensitive drum 1 to the developing sleeve 14. Accordingly, good developed images can be provided.

The reverse development is the development wherein the light potential region of the latent image receives the toner charged to the same polarity as the latent image to visualize the latent image. In a regular development, the dark potential region of the latent image receives the toner having the opposite polarity from the latent image.

The recent demands for the high resolution and the image quality improvement in the electrophotographic, requires improvement in the development, and therefore, the toner particle size is going to he reduced from a weight average particle size of 12 microns to the 8 microns approx. However, when the reverse development is carried out using the toner having an even smaller weight average particle size (8 microns or less), which will hereinafter be called ultrafine toner, many of reverse toner particles charged to the polarity opposite from that of the regular toner are contained in the coating layer on the sleeve surface. If this occurs, foggy background is produced. Particularly, in the case of fine toner particles, the deposition force due to the van der Waals force is a problem.

The fog in the white background portion in the regular development is not a big problem since the exposure portion is the white background. In the case of the reverse development, the charged dark potential portion corresponds to the white background. Therefore, particularly with the roller charging or the like, small unevenness of the potential exists, and calculation of the force acting on the toner (the force due to the electric field, image force or the like) reveals that the toner attracting force causes to produce the unevenness of the potential, which is a cause of fog. In order to prevent the reverse charge fog, a conventional method includes charging the developing bias. For example, a reversion contrast is reduced, or the peak-to-peak voltage of the developing bias AC component is reduced, or the developing bias AC component is increased. However, they all involve problems that the line thickness changes, the density decrease occurs in long term use, or the half-tone image is roughened, thus deteriorating the image quality. Japanese Patent Application Publication No. HEI-2-14704 and Japanese Patent Application Publication No. HEI-2-14705 disclose that the AC component of the developing bias is intermittently applied. These are to prevent the image white strips due to the unsmoothness of the magnetic flux density on the developing sleeve surface in the case of the regular development using toner having the superimposing average diameter of approximately 12 microns. The intermittent application method of the developing bias is not particularly considered. In addition, the ratio between the application period and the rest period of the developing bias is the 1:½–1:10, and the rest period is very long. With the fine particle toner of particle size of 4 microns or more and 8 microns or less, there arises a problem that the maintenance of the density in the a term operation is difficult.

When the particle size is less than 4 microns, the ratio of the regular toner of high charger (the 20 q/g or more) increases. The high triboelectric charge toner is strongly deposited on the photosensitive member due to the mirror image force and the Van der Waals force with the result that the particles are not pulled back to the developing sleeve even If the alternating electric field is applied so that the image contamination results.

SUMMARY OF THE INVENTION

It is a principal object of the present invention to provide a developing method and the developing device wherein a reverse charge fog is prevented.

It is another object of the present invention to provide a developing method and a developing device wherein the density decrease is prevented.

According to an aspect of the present invention there is provided a developing method comprising the steps of opposing a developer carrying member for carrying a developer to an image bearing member for bearing an electrostatic image; supplying, to the developer carrying member, insulative one component developer having a weight average particle size of 4–8 microns; forming, between the image bearing member and the developer carrying member, an alternating electric field having a back-transfer period, transfer period and rest period; wherein a ratio of a sum of the back-transfer period and the transfer period during a developing operation and the rest period is 5:1–2:1.

According to another of the present invention, there is provided a developing apparatus comprising: a developer container for containing insulative one component developer having a weight average particle size of 4–8 microns, said developer container having an opening; a developer carrying member, disposed in the opening and opposed to an image bearing member for bearing an electrostatic image, for carrying the developer; means for forming an alternating electric field having a back-transfer period, transfer period and rest period; wherein a ratio of a sum of the back-transfer period and the transfer period during a developing operation and the rest period is 5:1–2:1.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
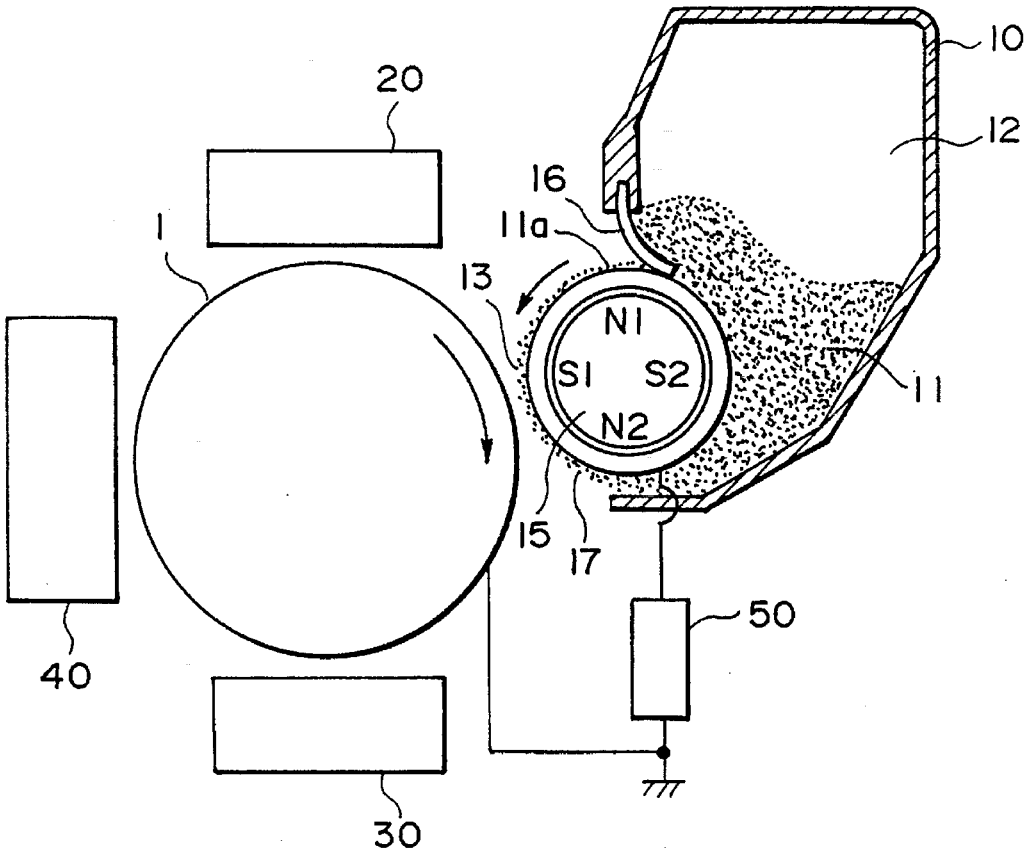
FIG. 1 is a schematic view a developing device according to embodiment 1.

FIG. 1 is an a sectional view of a developing device using the developing method according to an embodiment of the present invention.

Figure 12:
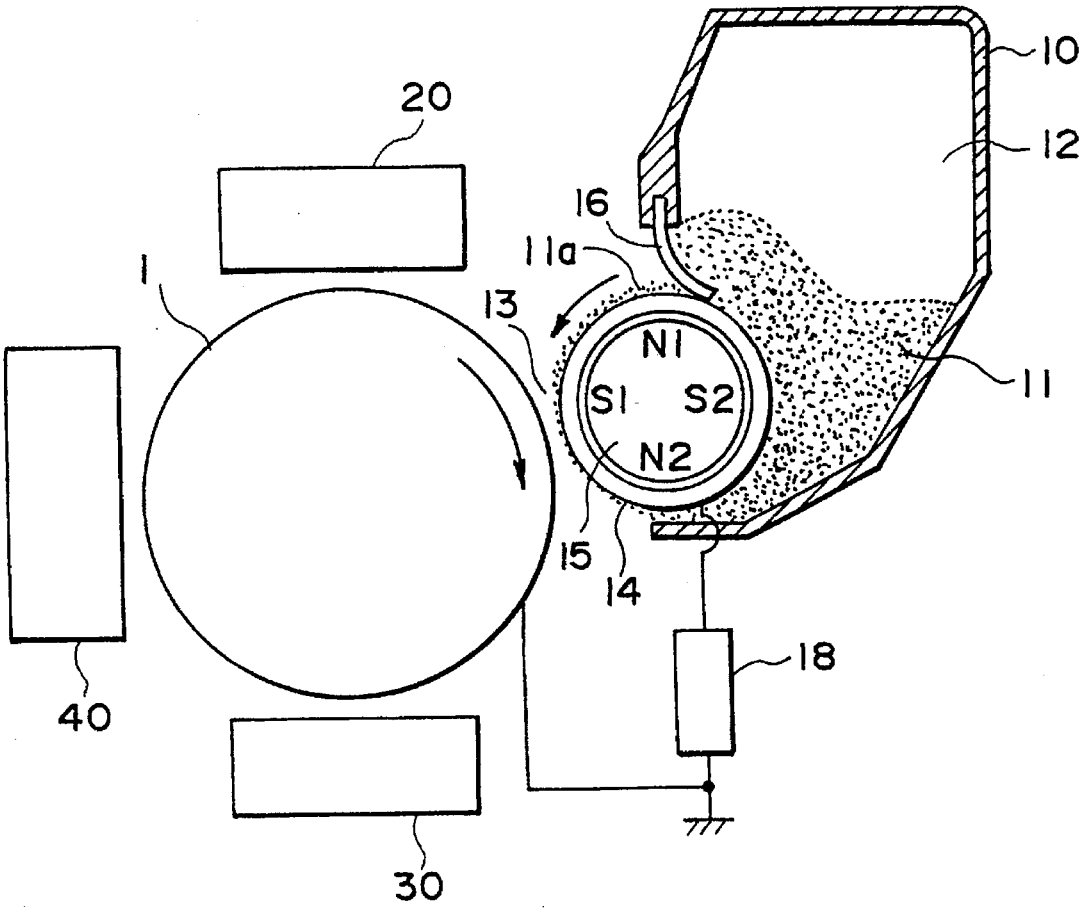
FIG. 12 illustrates a developing device.

The same reference numerals as in FIG. 12 are assigned to the elements having the corresponding functions, and detailed descriptions thereof are omitted for simplicity.

A cleaning blade of a cleaning means 40 has a hardness of 65° approx., and is fixed on a blade holder of steel, and is disposed with an amount of entrance of 0.5–1 mm relative to the photosensitive drum 1.

A gap maintaining member for maintaining a gap (SD gap) between the photosensitive drum 1 and the developing sleeve 14 is a capping type roller provided at each of the opposite ends of the developing sleeve 14.

The SD roller is of Derlin of POM (polyoxymethylene). The SD roller is contacted to the photosensitive member surface and is in rolling contact therewith, so that the predetermined gap is maintained between the photosensitive drum 1 and the developing sleeve 14.

An elastic blade 16 as the regulation member for regulating the toner amount applied to the developing zone 13 is of an elastic member such as the urethane rubber. It has a thickness of 1–1.5 mm, a free length of the 10 mm approx. and a contact pressure of the 30 g/cm approx., and is fixed to a holder of steel. It is contacted to a sleeve at a position corresponding to the magnetic pole N1 of the magnet 15. By the blade 16, a thin developer layer 11*a* is formed on the developing sleeve 14.

With this toner coating method, the thickness of the coating layer is mainly determined by the shape of the magnetic field end the electric field, and therefore, the thickness is not easily influenced by instability factors such as the triboelectric charge or the coagulation force of the toner. Additionally, the coated toner is attracted to the developing sleeve by the magnetic force, and therefore, the toner scattering is not significant.

The developer 11 comprises as a major component insulative magnetic toner, and preferably is externally added by a small amount of the silica fine powder. The Silica fine powder is added to control the triboelectric charge of the toner so as to increase the image density, and therefore, to reduce the image roughness. For example, a vapor phase silica (dry type silica) and/or wet type silica (wet silica) is added.

For example, the toner comprising negative toner comprising stylene-acrylic resin material and 60 parts by wt.

magnetite, and externally added strongly negative property dry type silica (for example, 100 $m^2$ of vapor phase silica is added with 10 parts by wt. of HMDS (hexamethyldisilazane) and heated) is suitable to reverse-develop the negative electrostatic latent image.

More particularly, the toner 11 is charged to the polarity for developing the electrostatic latent image by the friction with the developing sleeve 17 mainly. The base material of the toner 11 is an insulative magnetic toner having a volume resistivity of approx. $10^{13}$ Ohm.cm, comprising a binder resin mainly comprising stylene-acrylic copolymer resin material, the 60 weight % of magnetite and the 1 weight % of the metallic complex salt of the mono-azo-dye as the negative electrification control material. It is added with the 0.4 weight % of hydrophobic silica fine particle to increase the flowability, on the basis of the toner weight. The toner is charged to the negative polarity by the friction with the developing sleeve 17.

The magnetic pole S1 of the magnet roller 15 functions to form a magnetic field in the developing zone 13 to prevent fog, thus permitting formation of sharp line images. The magnetic pole N1 is effective to regulate the toner, and the magnetic pole N2 and the S2 function to feed the toner.

In this developing device, the non-contact development is used, and the development blade is of elastic member.

The developing device 10 of the present embodiment is provided with a developing container 12 containing the magnetic toner 11 which is the above described insulative one component magnetic developer, and the developing sleeve 17 is disposed in the opening thereof faced to the photosensitive drum 1 with the gap of the 300 microns relative to the photosensitive drum. The toner 11 in the developing container 12 is attracted to the developing sleeve 17 by the magnet roller 15 in the developing sleeve 17, and is triboelectrically charged by the elastic development blade 16. It is applied thereon as a thin layer by the toner, and is fed to the developing zone 13 where it is faced to the photosensitive drum 1.

The toner layer 11 fed to the developing zone 13 is consumed for development of the electrostatic latent image on the photosensitive drum 1, so that the latent image is reverse-developed and visualized into a toner image.

During the development, the developing bias of the AC voltage biased with the DC voltage is applied to the bias voltage source 50 according to the present invention. In the the present embodiment, the bias voltage source 50 intermittently applies the AC component of the developing bias such that the back-transfer, developing and rest fields are repeated in this order.

Since the elastic development blade 16 functions to regulate and charge the toner, it is of the urethane rubber or the like. To provide it with proper elasticity, it has a hardness of 65° (JISA), a thickness of 1.2 mm, and a free length of 10 mm. It is contacted to the developing sleeve at the pressure of approx. 30 g/cm.

The developing sleeve 17 is of aluminum material and is sand-blasted. For the sand blasting, the use is made with irregular abrasive grain, for example, alundum abrasive grain (trademark: molundum A#100 available from SHOWA DENKO KABUSHISKIKAISHA, JAPAN). The blasting conditions are pressure of 2.0 kg/$cm^2$ and time period of 20 sec. After the blasting, as desired, air blowing or cleaning with a cloth moistened with the alcohol, may be performed. Thereafter, phenolic resin liquid in which carbon and graphite are dispersed can be spray-coated, and it is dried. The center line average roughness of the surface of the developing sleeve 17 (Ra) is approx. 2.2 microns.

The average particle size of the insulative one component magnetic toner is the approx. 7 microns.

Figure 2:
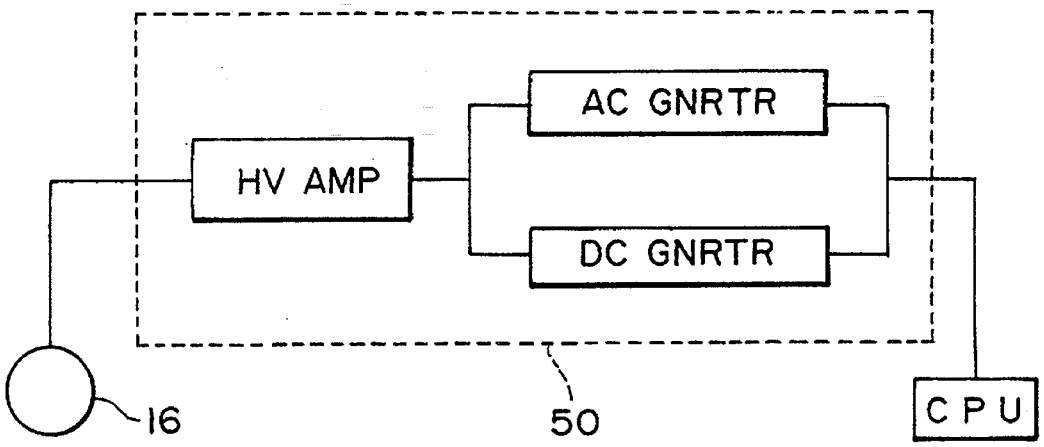
FIG. 2 illustrates a developing bias voltage source according to an embodiment 1 of the present invention.

Referring to FIG. 2, the description will be made as to the developing bias voltage source 50 used in the present invention. When the developing bias voltage source 50 receives a predetermined signal from the CPU for controlling the main assembly, it produces an AC waveform (rectangular wave) which is intermittent as will be described hereinafter, by an AC component generator, and produces a DC offset voltage by a DC component generator. These are amplified by a high voltage amplifier, and the waveform for the development is produced, the waveform having the AC (intermittent rectangular wave) of Vpp=1600 V, a frequency 1800 Hz and a DC of −450 V.

Figure 3A:
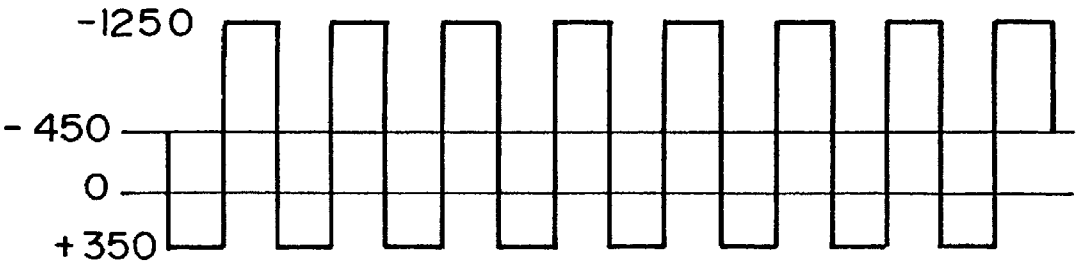
FIGS. 3A, 3B and 3C show a developing bias waveform according to embodiment 1 of the present invention.
Figure 3B:
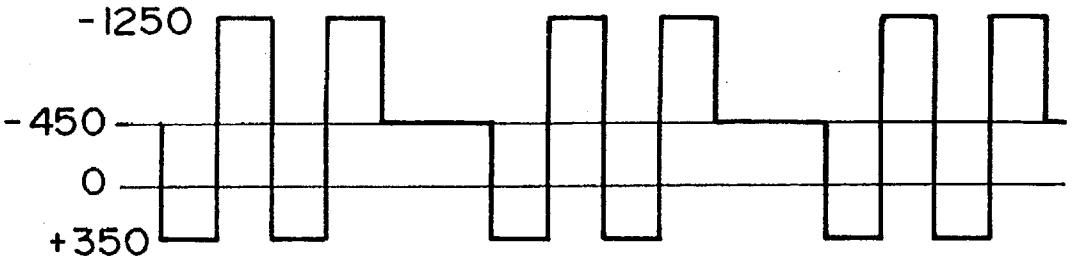
Figure 3C:
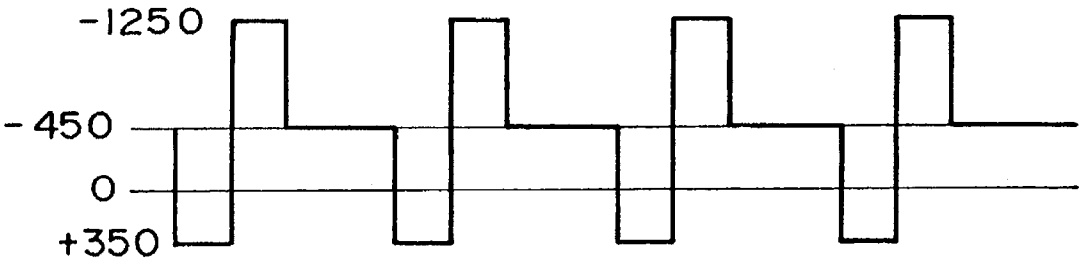

FIG. 3 shows a specific developing bias waveform. FIG. 3A is a conventional rectangular wave, and FIG. 3B and FIG. 3C are an intermittent rectangular wave according to the present invention.

Referring to FIG. 3B as described hereinbefore, the developing electric field is in the order of transfer-back, transfer and rest field (the negative toner), and +350 V, −1250 V and −450 V is repeated with AC component off. On the other hand, the revere charge toner having the positive polarity moves in the opposite direction, i.e., transfer, back-transfer and rest. In this case, one off-period come after two rectangular-waves come, and therefore, this is called "blank ratio of 2:1.

As regards FIG. 3C the order of repetition is the same as in 3B, and one rest comes after one rectangular waves, and therefore, the blank ration is 1:1. Similarly, the waveforms of the blank ratio of 3:1 of 4:1 can be formed.

Figure 4A:
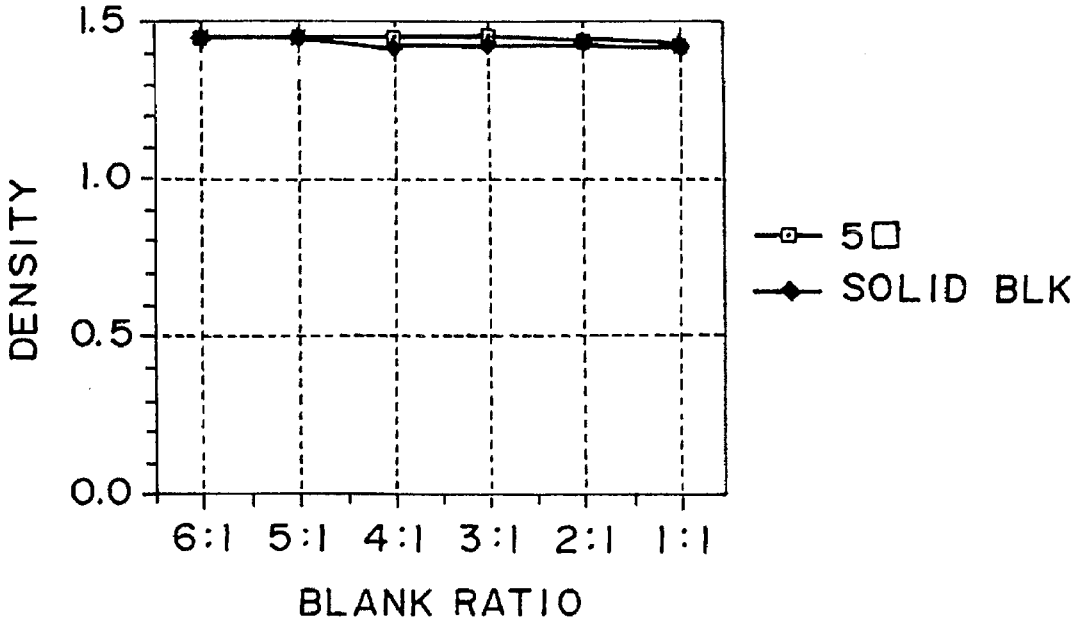
FIGS. 4A and 4B illustrate the effect by embodiment 1 of the present invention.
Figure 4B:
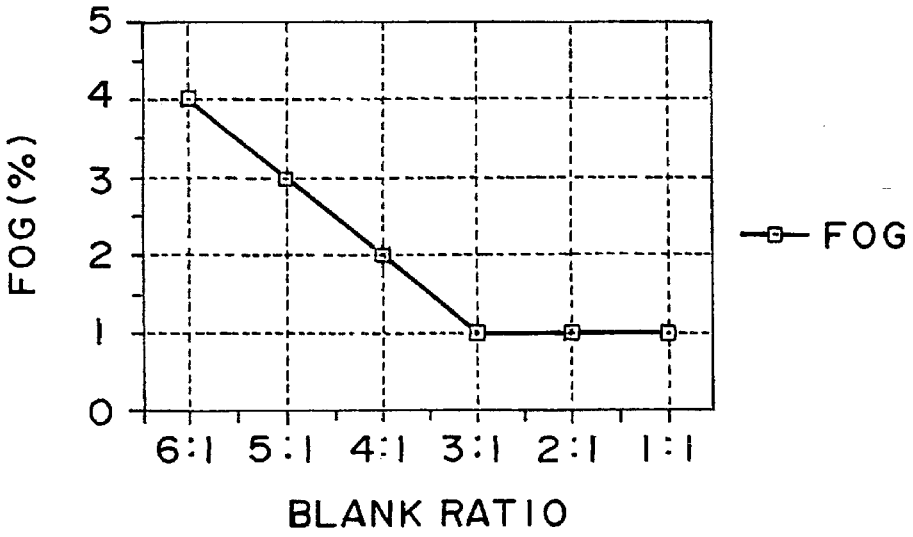

The description will be made as to the experiment examples using the developing bias waveform of this embodiment. Using the above-described developing device, the image forming operations were carried out under normal conditions. FIG. 4 shows the results. FIG. 4A shows a relation between the blank ratio and the image density. As will be understood, the density hardly changes within the range between the blank ratios 6:1–2:1. However, slight density decrease is observed with the blank ratio of 1:1. FIG. 4B shows a relationship between the blank ratio and the image fog. As will be understood, the fog is improved significantly with the increase of the blank ratio.

Figure 5A:
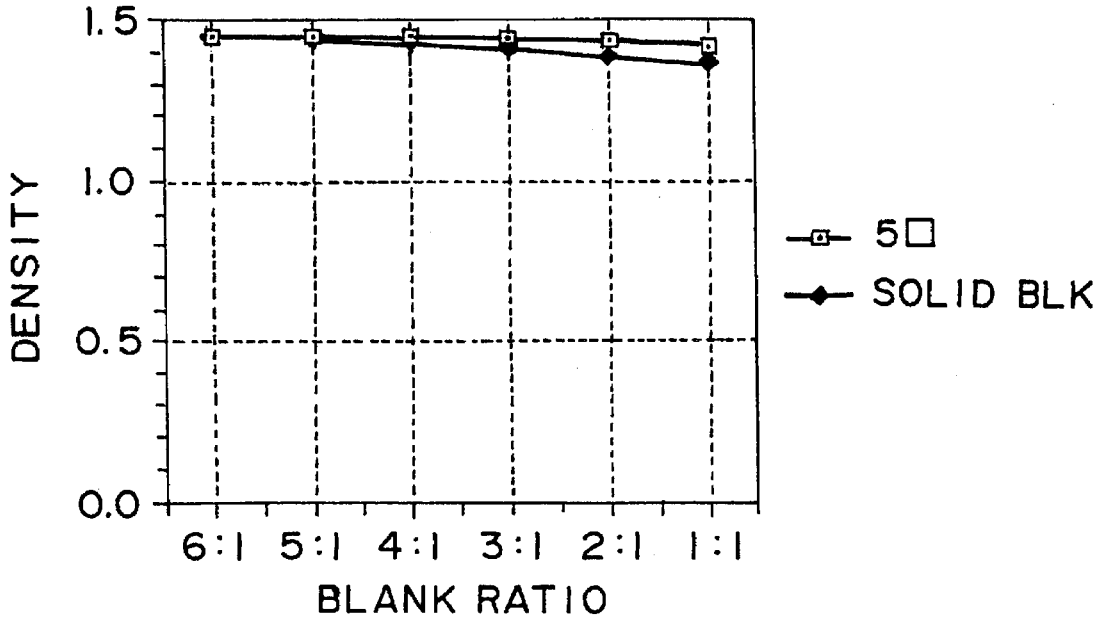
FIGS. 5A and 5B illustrate the effect by embodiment 1 of the present invention.
Figure 5B:
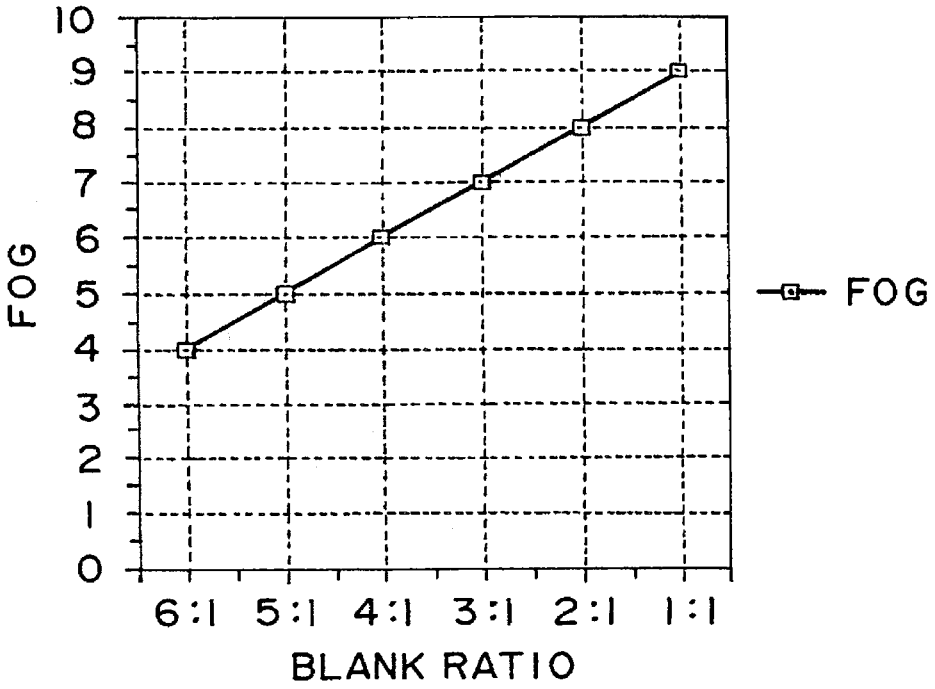

FIGS. 5A, 5B, and 5C show the result of experiments wherein the developing electric field is repeated in the order of transfer, back-transfer and rest periods. i.e., −1250 V, +350 V, −450 V with AC component off, the order being opposite from the embodiment of the present invention. FIG. 5A shows a relation between the blank ratio and the image density. As will be understood, the density slightly decreases with increase of the blank ratio. FIG. 5B shows a relation between the blank ratio and the image fog. As will be understood, the fog becomes poor with increase of the blank ratio.

The results of the experiments of the inventors shows that the reverse charge fog is improved with increase of the blank ratio. However, if the blank ratio is 2:1 or larger, the density reduction is liable to occur in a long term operation. Therefore, the a ratio is preferably larger than 5:1 and smaller than 2:1, more preferably 3:1–2:1.

Figure 6A:
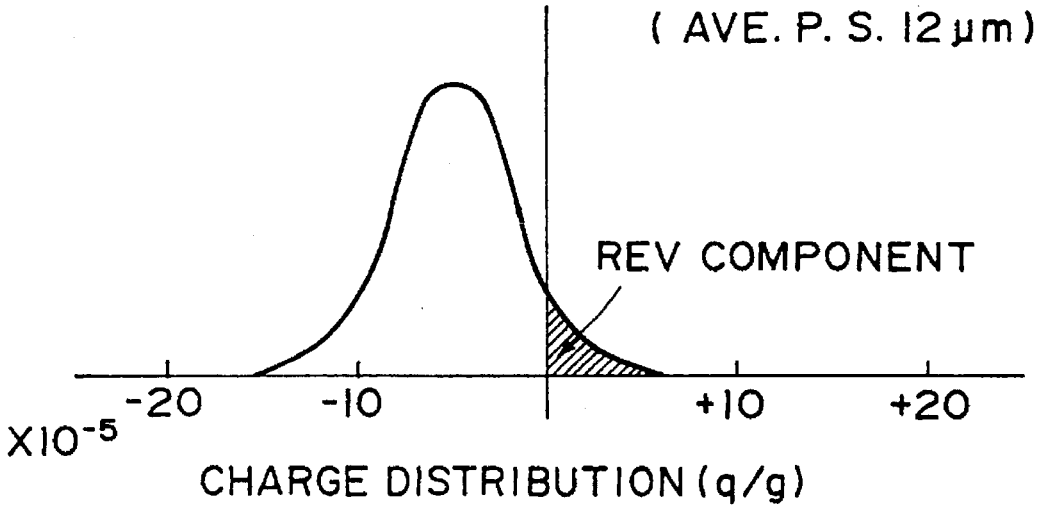
FIGS. 6A and 6B illustrate a triboelectric charge distribution of the toner by embodiment 1 of the present invention.
Figure 6B:
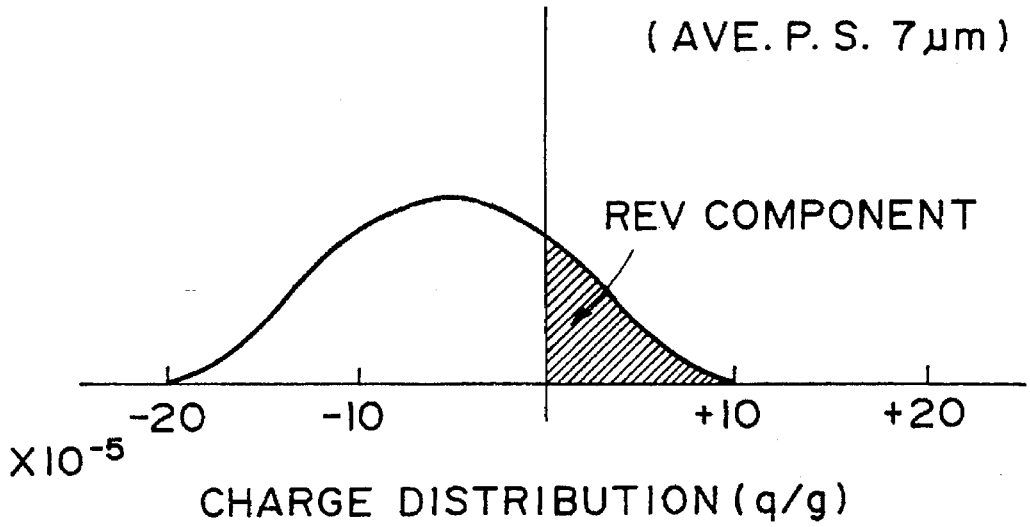

The description will be made as to the relation between the average particle size of the toner and the advantageous effects of the present invention. FIGS. 6A and 6B show the triboelectric charge distribution (charge distribution) of the toner having the average particle size of 12 microns which has conventionally been used, and that of the toner having an average particle size of 7 microns. The data are based on the analysis using the Easpert analyzer (available from Hosokawa MICRON KABUSHIKI KAISHA, Japan) for the toner coated as a thin layer on the developing sleeve.

FIGS. 6A and 6B show that with the average particle size of 12 microns, the triboelectric charge distribution is sharp, and an amount of the reverse component (positive charging toner) is small, but with the toner of the average particle size of 7 microns has broad triboelectric charge distribution, and therefore, the amount of the reverse component is large. For this reason, with the toner of the average particle size of 7 microns results in the reverse charge fog if the conventional bias is used, that is, it is approx. 4%. By the bias of the present invention, the reverse charge fog is reduced to approx. 1%.

The description will be made as to the method of measuring the fog. The reflectances are measured on an unused sheet and on a solid-white printed sheet at 5 positions, respectively, and the difference between the averages is taken as the fog level (%). The reflection ratio has been measured using densitometer TS-6DS (available from TOKYO DENSHOKU KABUSHIKI KAISHA, JAPAN).

The results of experiments by the inventors show that the advantageous effects of the present invention are remarkably observed with the average particle size of 4 microns or larger and 8 microns or smaller, although it is different depending on the toner manufacturing conditions such as pulverization and classification conditions.

The advantageous effects of the present invention may change depending on the surface roughness of the developing sleeve (Ra). More particularly, if the surface roughness is small, the triboelectric charge distribution of the toner coated on the developing sleeve changes such that the background fog component rather than the reverse charge fog increases with the result of the reduction of the advantageous effect of the present invention. According to the experiment of the inventors, the surface roughness Ra of 2.5–1.5 microns is preferable, further particularly, 2.2 microns is proper, and the advantageous effect of the present invention decreases with 1.5 microns or less.

Embodiment 2

Figure 7:
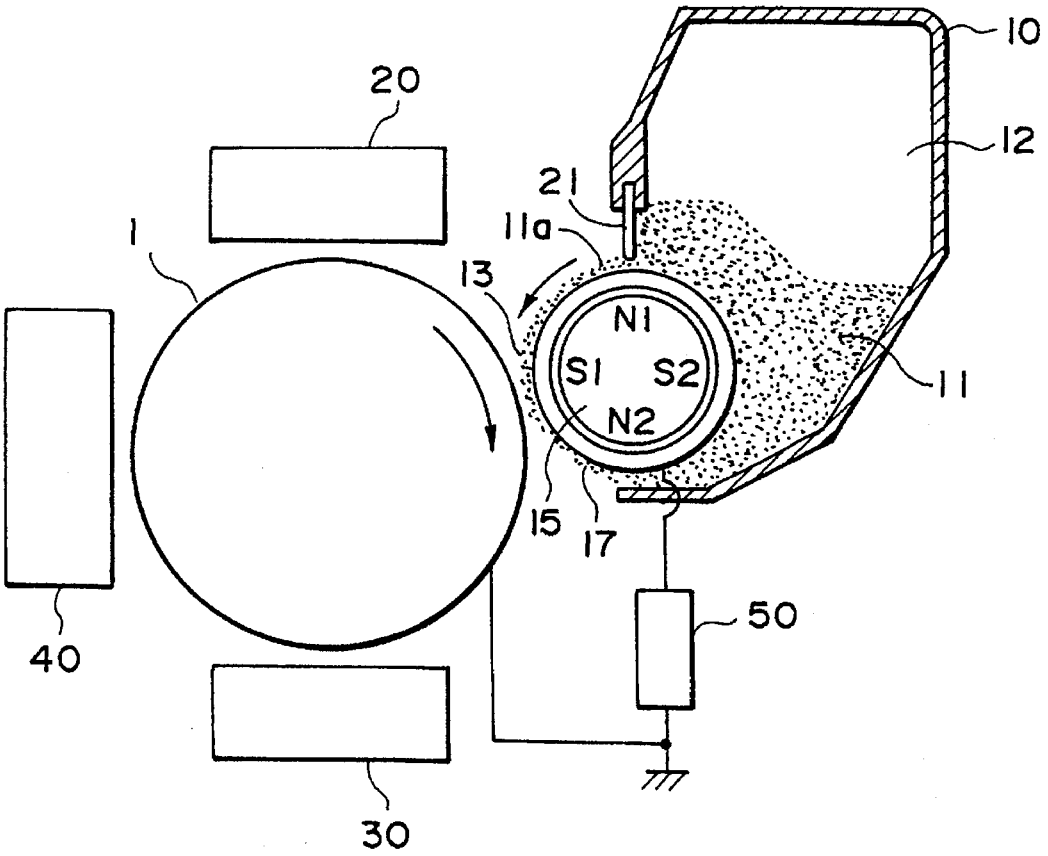
FIG. 7 illustrates a developing device according to embodiment 2 of the present invention.

FIG. 7 shows a developing device according to a second embodiment of the present invention. In this embodiment, the development blade is of iron magnetic blade (doctor blade). As regards the developing sleeve and the toner, the same is used as in embodiment 1. The other structures are substantially the same as in embodiment of FIG. 1. The same reference numerals as in FIG. 1 are assigned to the elements having the corresponding functions, and detailed descriptions thereof are omitted for simplicity.

The iron blade (doctor blade) is used for the development blade because the iron blade does not directly rub the developing sleeve as contrasted to the case of elastic blade so that the lifetime of the developing sleeve is longer, and because the iron blade is less expensive than the elastic blade.

In FIG. 7, in order to regulate the toner and charge it, a proper gap is desirable between the developing sleeve and itself. It is the approx. 240 microns in this embodiment. The thickness of the development blade 21 is approx. 1 mm, and is supplied with the same bias voltage as for the developing sleeve. Inside the developing sleeve, there is a cutting pole (N1) of the magnet at a position faced to the development blade 21. The toner fed by the rotation of the developing sleeve is regulated by the magnetic confining force. Here, the magnetic force of the N1 pole is 650 Gauss.

In the case of the doctor blade of this embodiment, the regulation force and the triboelectric charge application force for the toner is poor as compared with the elastic blade of the foregoing embodiment 1, and therefore, the amount of the reverse component is larger on the developing sleeve in the development zone.

Figure 8A:
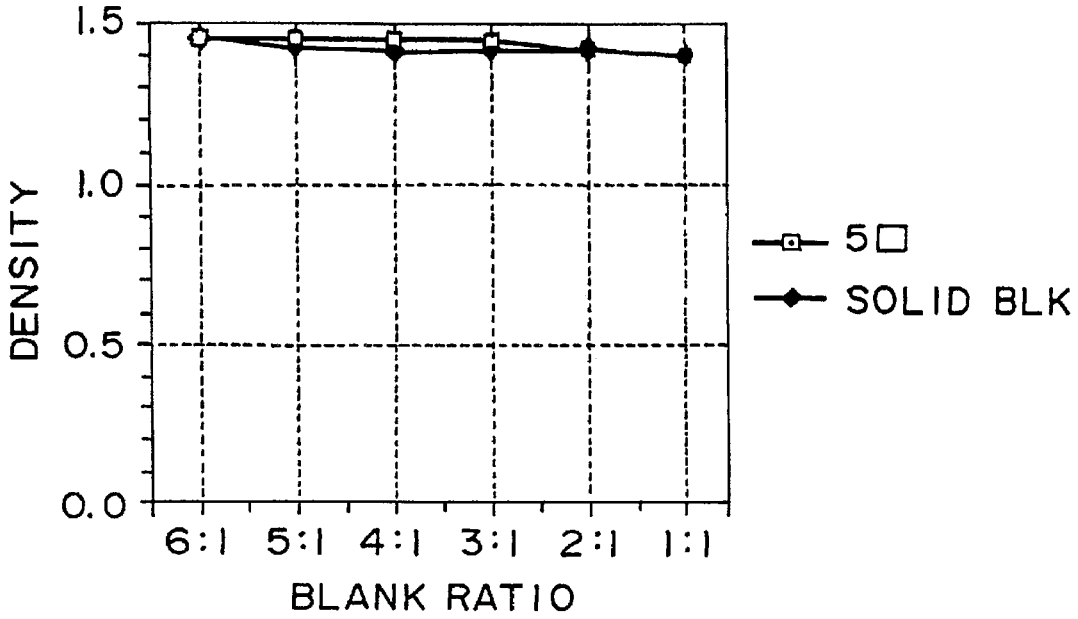
FIGS. 8A and 8B illustrate the effects according to embodiment 2 of the present invention.
Figure 8B:
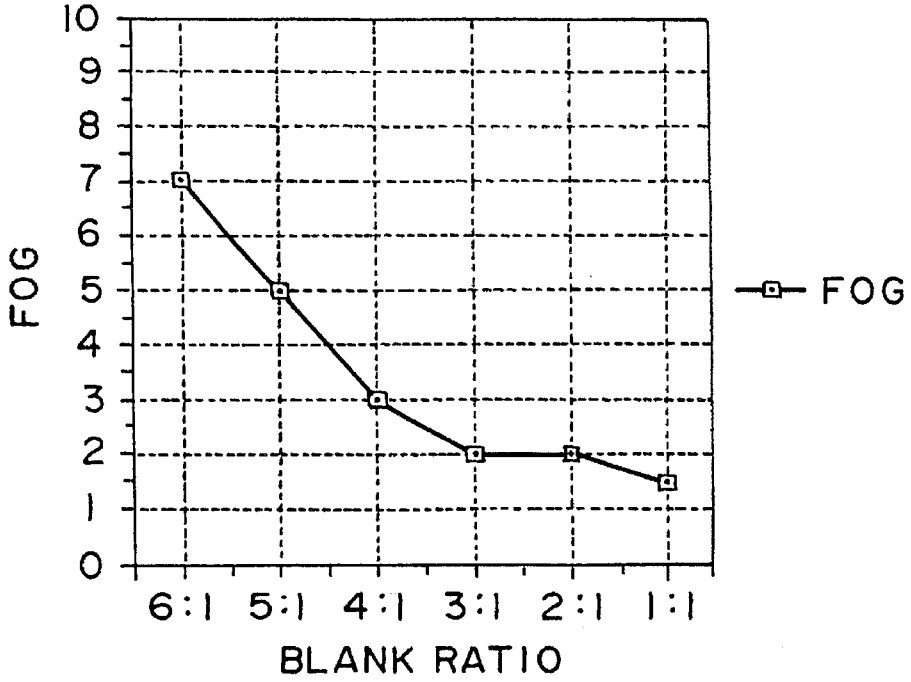

FIGS. 8A and 8B show the results of the experiments by the inventors. FIG. 8A shows a relation of the blank ratio and the image density. As will be understood, the density does not change up to 2:1.

FIG. 8B shows a relation between the blank ratio and the image fog. As will be understood, the fog was the approx. 8% (not shown) with the conventional bias, but when the blank ratio is increased to the 2:1, the fog is significantly improved to approx. 2.0%.

Figure 9A:
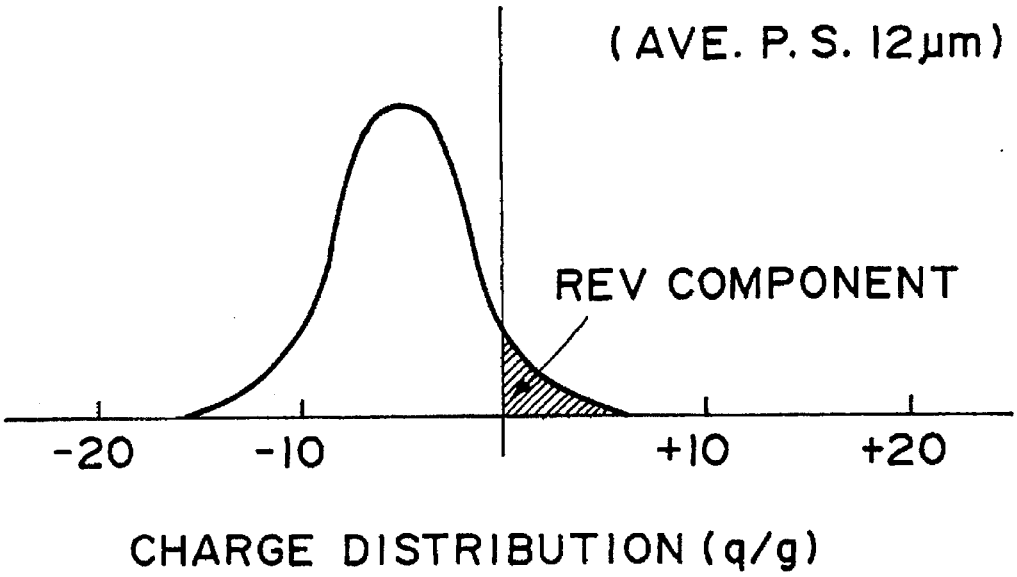
FIGS. 9A and 9B show a triboelectric charge distribution of the toner according to embodiment 2 of the present invention.
Figure 9B:
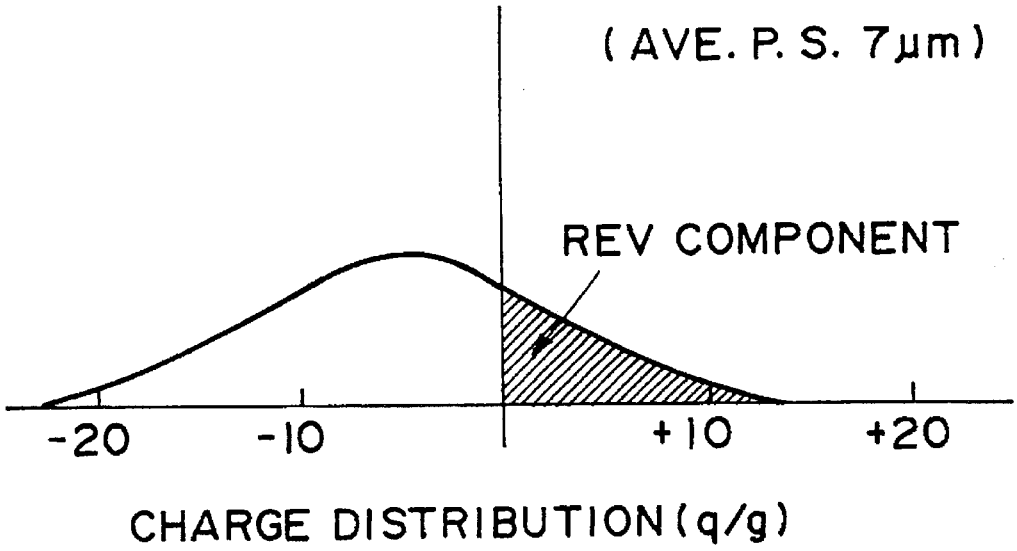

FIGS. 9A and 9B show the triboelectric charge distributions for the toner having an average particle size of 12 microns and the toner having the average particle size of 7 microns, in embodiment 2. The data are obtained through the same process as in embodiment 1. As will be understood from FIG. 9A, with the toner of average particle size of 12 microns, the triboelectric charge distribution is sharp, and the amount of the reverse component (positive toner) is small, but with the toner having average particle size of 7 microns, the triboelectric charge distribution is broader than in embodiment 1, and therefore, the reverse component is larger. If the toner having average particle size of 7 microns is used with the conventional bias, the reverse charge fog is significant (approx. 7%), but the use of the bias of this embodiment reduces it to the approx. 2.0%.

It will be understood that embodiment 2 is effective to suppress the reverse charge fog.

Embodiment 3

Figure 10:
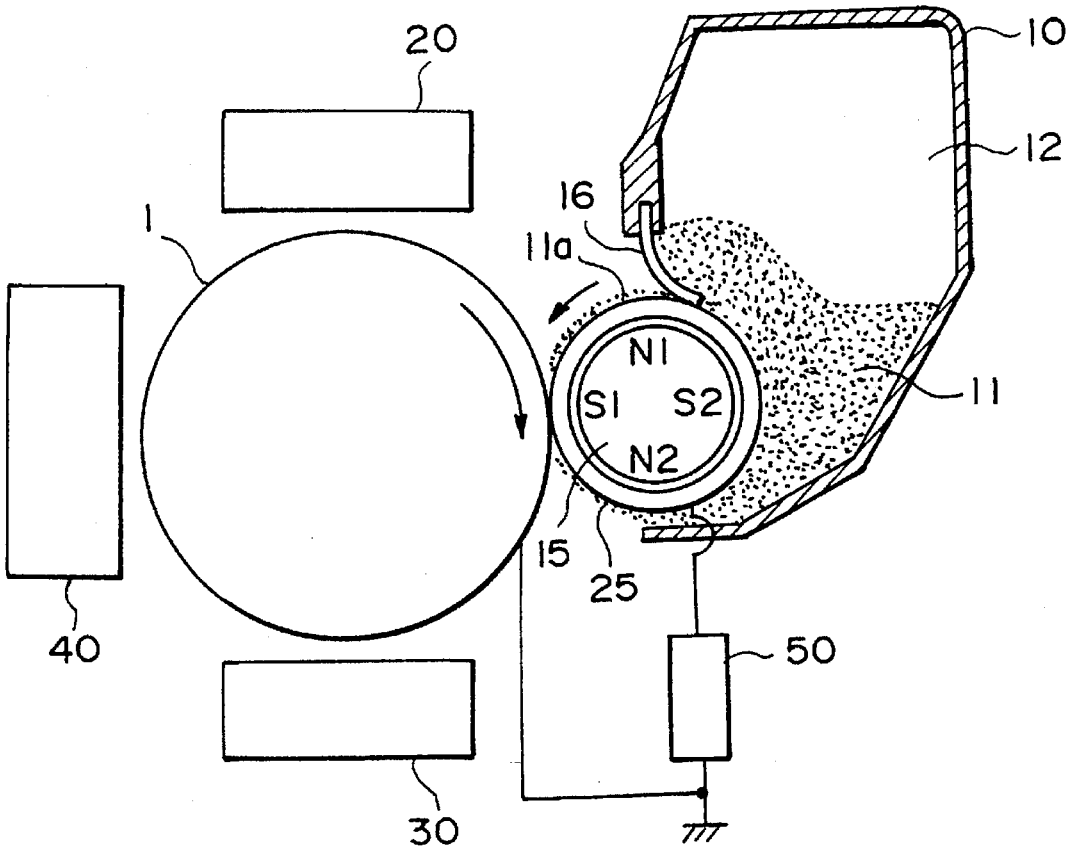
FIG. 10 shows a developing device according to embodiment 3 of the present invention.

FIG. 10 shows a developing device according to a third embodiment. In this embodiment, the developer carrying member is of elastic material sleeve 25, and the elastic developing sleeve and the photosensitive drum are contacted to each other in the development zone. As regards the development blade and the toner, they are the same as in embodiment 1. The other structures are substantially the same as in embodiment of 1. The same reference numerals as in FIG. 1 are assigned to the elements having the corresponding functions, and detailed descriptions thereof are omitted for simplicity.

The elastic developing sleeve 25 has an aluminum tube and a surface elastic layer of approx. 3 mm thick of an elastic layer of electroconductive rubber such as the EPDM rubber in which carbon is dispersed. The surface of the elastic layer is abraded to the surface roughness Ra of approx. 2 microns. In the elastic developing sleeve 25, the same magnet as in embodiment 1 is disposed.

Figure 11A:
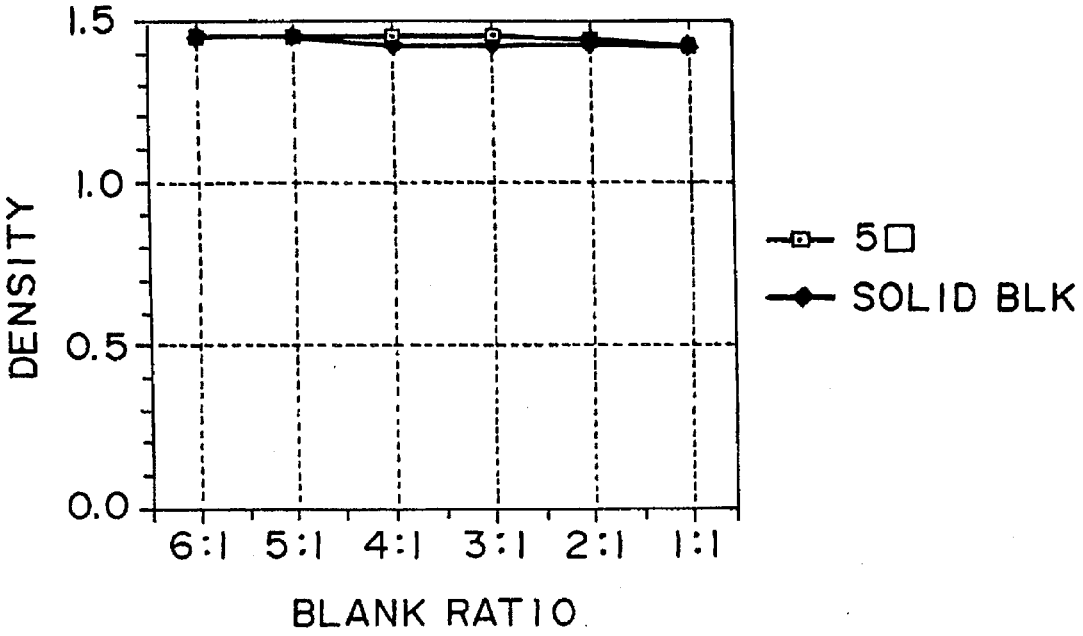
FIGS. 11A and 11B illustrate the effect according to embodiment 3 of the present invention.
Figure 11B:
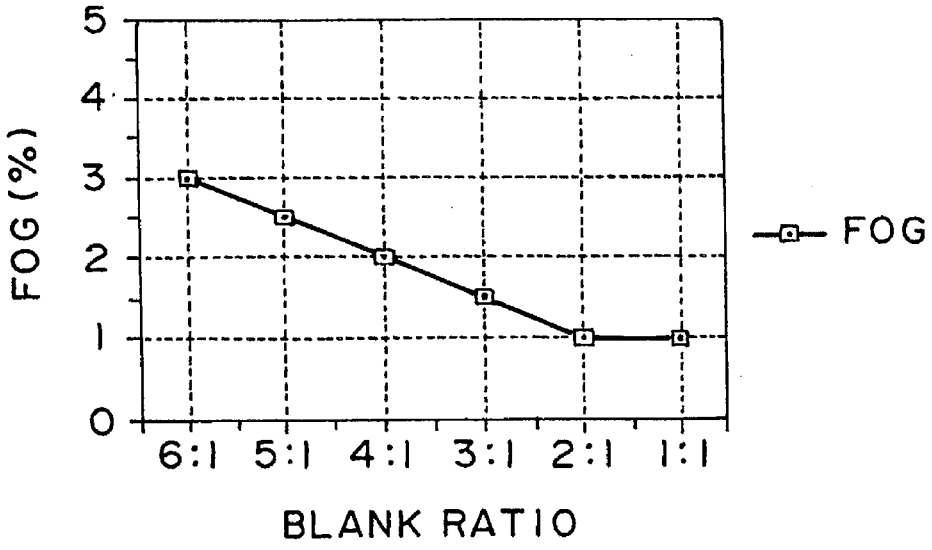

FIG. 11A shows advantageous effect of the present invention. FIG. 11A shows the relation between the blank ratio and the image density. As will be understood, the density does not change even if the blank ratio is increased. FIG. 11B shows relation between the blank ratio and the image fog. As will be understood, the fog is significantly improved with the increase of the blank ratio.

It will be understood that the bias of the present invention is effective to improve the reverse charge fog without the decrease of the image density. The fog of the approx. 4% with the conventional bias is reduced to approx. 1.0% by the blank bias application (blank ratio of 2:1), as in embodiment 1.

In embodiment 3, the developer carrying member is the elastic developing sleeve, but this is not limiting, and the developing sleeve of embodiment 1 is usable. In this case, the toner particle brush is erected at the developing zone by the magnetic pole (S1 pole) in the developing sleeve, and therefore, the contact between the developing sleeve and the photosensitive drum can be avoided if the gap therebetween is 20–50 microns, while the contact development is effected by the contact between the photosensitive drum and the erected brush of the toner.

In the foregoing embodiments, the AC component of the developing bias has a blank bias of the rectangular wave, but a triangle wave a saw-teeth wave a sunisoidal wave or the like is usable.

While the invention has been described with reference to the structures disclosed herein, it is not confined to the details set forth and this application is intended to cover such modifications or changes as may come within the purposes of the improvements or the scope of the following claims.

What is claimed is:

1. A developing method comprising the steps of:

opposing a developer carrying member to an image bearing member, the developing carrying member carrying a developer to the image bearing member for bearing an electrostatic image;

supplying, to the developer carrying member, insulative one component developer having a weight average particle size of 4–8 microns;

forming, between the image bearing member and the developer carrying member, an alternating electric field having a back-transfer period, transfer period and rest period;

wherein a blank ratio of a sum of (i) the back-transfer period plus (ii) the transfer period and the rest period, during a developing operation, is 5:1–2:1.

2. A method according to claim 1, wherein a charge polarity of the developer and a charging polarity of the image bearing member are the same.

3. A method according to claim 1, wherein the developer contains externally added silica particles.

4. A method according to claim 1, wherein the developer is charged to a predetermined polarity by friction with the developer carrying member.

5. A method according to claim 1, wherein the blank ratio is 3:1–2:1.

6. A method according to claim 1, wherein the developing electric field repeats the back-transfer period, transfer period and rest period in the order named.

7. A method according to claim 1, wherein the developer is a magnetic developer.

8. A developing apparatus comprising:

a developer container for containing insulative one component developer having a weight average particle size of 4–8 microns, said developer container having an opening;

a developer carrying member, disposed in the opening and opposed to an image bearing member for bearing an electrostatic image, for carrying the developer;

means for forming an alternating electric field having a back-transfer period, transfer period and rest period;

wherein a blank ratio of a sum of (i) the back-transfer period plus (ii) the transfer period and the rest period, during a developing operation, is 5:1–2:1.

9. An apparatus according to claim 8, further comprising an elastic blade urged to said developer carrying member to regulate a thickness of a layer of the developer on said developer carrying member.

10. An apparatus according to claim 9, wherein the developer is charged to a predetermined polarity by friction with said elastic blade.

11. An apparatus according to claim 10, wherein the charge polarity of the developer and a charging polarity of the image bearing member are the same.

12. An apparatus according to claim 8, wherein the electric field forming means applies a rectangular-shaped bias voltage to said developer carrying member.

13. An apparatus according to claim 8, wherein said developer carrying member has a surface roughness Ra of 1.5–2.5 microns.

14. An apparatus according to claim 8, wherein the developer contains externally added silica particles.

15. An apparatus according to claim 8, wherein the blank ratio is 3:1–2:1.

16. An apparatus according to claim 8, wherein said electric field forming means repeats the back-transfer period, the transfer period and the rest period in the order named.

17. An apparatus according to claim 8, wherein the developer is a magnetic developer.

* * * * *

UNITED STATES PATENT AND TRADEMARK OFFICE

CERTIFICATE OF CORRECTION

PATENT NO. 5,659,840
DATED August 19, 1997
INVENTOR(S) Toshio MIYAMOTO et al.

It is certified that error appears in the above-identified patent and that said Letters Patent is hereby corrected as shown below:

Column 1:

Line 9, "fur" should read --for--; and

Line 67, "a" should read --an--.

Column 2:

Line 11, "-100V," should read ---100v--;

Line 14, "having" should read --has--;

Line 29, "electrophotographic," should read "electrophotographic--;

Line 31, "he" should read --be--;

UNITED STATES PATENT AND TRADEMARK OFFICE

CERTIFICATE OF CORRECTION

PATENT NO. : 5,659,840
DATED : August 19, 1997
INVENTOR(S) : Toshio MIYAMOTO et al.

It is certified that error appears in the above-identified patent and that said Letters Patent is hereby corrected as shown below:

Line 32, "the" should be deleted; and

Line 36, "of" should read "of the".

Column 3:

Line 4, "the" (third occurrence) should be deleted;

Line 15, "If" should read --if--;

Line 38, "another" should read --another aspect--; and

Line 57, "a" should read --of a--.

UNITED STATES PATENT AND TRADEMARK OFFICE

CERTIFICATE OF CORRECTION

PATENT NO. 5,659,840
DATED August 19, 1997
INVENTOR(S) Toshio MIYAMOTO et al.

It is certified that error appears in the above-identified patent and that said Letters Patent is hereby corrected as shown below:

Column 4:

Line 51, "end" should read --and--; and

Line 60, "Silica" should read --silica--.

Column 6:

Line 2, "the" should be deleted;

Line 23, "revere" should read --reverse--;

Line 25, "come" should read --comes--;

Line 26, "-waves come," should read ---wave,--;

UNITED STATES PATENT AND TRADEMARK OFFICE

CERTIFICATE OF CORRECTION

PATENT NO. : 5,659,840
DATED : August 19, 1997
INVENTOR(S) : Toshio MIYAMOTO et al.

It is certified that error appears in the above-identified patent and that said Letters Patent is hereby corrected as shown below:

Line 29, "waves," should read --wave,--; and

Line 31, "of" (third occurrence) should read --or--.

Column 7:

Line 58, "the" (first occurrence) should be deleted.

Column 8:

Line 10, "the" (second occurrence) should be deleted;

Line 28, "the" should be deleted; and

UNITED STATES PATENT AND TRADEMARK OFFICE

CERTIFICATE OF CORRECTION

PATENT NO. : 5,659,840
DATED : August 19, 1997
INVENTOR(S) : Toshio MIYAMOTO et al.

It is certified that error appears in the above-identified patent and that said Letters Patent is hereby corrected as shown below:

Line 39, "of" should be deleted.

Column 9:

Line 8, "wave" (all occurrences) should read --wave,--.

Signed and Sealed this

Twenty-eighth Day of April, 1998

Bruce Lehman

*Attest:*

BRUCE LEHMAN

*Commissioner of Patents and Trademarks*

*Attesting Officer*